United States Patent [19]

Kizaki et al.

[11] Patent Number: 4,577,480

[45] Date of Patent: Mar. 25, 1986

[54] METHOD AND APPARATUS FOR CONTROLLING ROLLING CORRECTION IN ROLLING MILL

[75] Inventors: Kanji Kizaki, Ebina; Hajime Ishii, Tokyo; Noboru Taguchi; Hiroshi Kuwamoto, both of Fukuyama, all of Japan

[73] Assignees: Ishikawajima-Harima Jukogyo Kabushiki Kaisha; Nippon Kokan Kabushiki Kaisha, both of Tokyo, Japan

[21] Appl. No.: 618,132

[22] Filed: Jun. 7, 1984

[30] Foreign Application Priority Data

Jun. 22, 1983 [JP] Japan ..... 58-112099
Jun. 22, 1983 [JP] Japan ..... 58-112100

[51] Int. Cl.[4] ..... B21B 37/12; B21B 29/00

[52] U.S. Cl. ..... 72/8; 72/16; 72/20; 72/21; 72/243; 72/245

[58] Field of Search ..... 72/243, 242, 245, 21, 72/20, 19, 16, 17, 8, 241

[56] References Cited

U.S. PATENT DOCUMENTS 2,792,730 5/1957 Cozzo ..... 72/248
3,855,830 12/1974 Kitanosono et al. ..... 72/16
4,494,396 1/1985 Iwanami et al. ..... 72/243

FOREIGN PATENT DOCUMENTS 30984 5/1978 Japan .
0061908 4/1983 Japan ..... 72/8
2100472 12/1982 United Kingdom ..... 72/20

*Primary Examiner*—Francis S. Husar
*Assistant Examiner*—Steve Katz

[57] ABSTRACT

In a rolling mill of the type in which horizontal pushing forces are exerted to a work roll exerted with a rolling force so as to bend the work roll, thereby controlling the flatness of a strip being rolled, a method and apparatus for controlling rolling correction in the rolling mill for eliminating variations in rolling load due to the horizontal pushing forces.

3 Claims, 5 Drawing Figures

METHOD AND APPARATUS FOR CONTROLLING ROLLING CORRECTION IN ROLLING MILL

BACKGROUND OF THE INVENTION

The present invention relates to a rolling mill in which a horizontal pushing force is imparted to a work roll, which is applied with a rolling force, so as to bend the work roll, whereby flatness of a strip can be controlled, and more particularly a method and apparatus for controlling rolling correction, thereby eliminating variations in rolling load caused by the horizontal pushing force.

In order to make the fine and correct control of widthwise flatness of a strip being rolled, there has been devised and demonstrated a rolling mill in which horizontal pushing forces are individually exerted toward the axis of a work roll so that the bending with a higher degree of freedom can be provided.

For instance, FIGS. 1 and 2 show such rolling mill as described above which is of a five-high type. Work rolls 3 and 4 and an intermediate roll 5 are interposed between backup rolls 1 and 2. The lower (or upper) work roll 4 has a diameter as small as possible so long as it has a sufficient strength, and its axis is offset to the downstream side (or upstream side) of the passage of a strip 6 being rolled. A holding roll 7 is made into contact with the downstream side of the lower work roll 4 and a sectioned roll 8 is made into contact with the downstream side of the holding roll 7. The axes of the lower work roll 4, the holding roll 7 and the sectioned roll 8 are in a common plane which is substantially horizontal (or, in practice, a little inclined downwardly in the downstream side). The sectioned roll 8 comprises a plurality (six in FIG. 2) of roll elements $8_1$–$8_6$ spaced apart from each other by a suitable distance in the axial direction of the shaft 8*a*. The piston rods of hydraulic cylinders $9_1$–$9_7$ are joined to the shaft 8*a* as shown so that individual pushing forces can be exerted to the lower work roll 4. The backup roll 2 is adapted to be moved vertically by means of a reduction hydraulic cylinder 10 so that the vertical rolling force is produced between the upper and lower work rolls 3 and 4.

Therefore in the rolling mill of the type described above, the hydraulic cylinder 10 produces the vertical rolling force between the upper and lower work rolls 3 and 4 while the hydraulic cylinders $9_1$–$9_7$ produce individual pushing forces which are applied through the roll elements $8_1$–$8_6$ to the lower work roll 4. As a result, the lower work roll 4 is bent in the horizontal direction. Depending upon the vertical components of the horizontal bending of the work roll 4, the distance between the upper and lower work rolls 3 and 4 can be arbitrarily varied so that the flatness of the strip 6 being rolled can be finely and correctly controlled.

However, in the rolling mill of the type described above, variations of the horizontal pushing forces applied to the lower work roll 4 cause variations of the rolling force so that there arises the problem that the thickness of the strip 6 leaving the work rolls 3 and 4 varies. In this case, as indicated by the characteristic curves (I), (II) and (III) shown in FIG. 3, even when the range of variations in horizontal pushing forces is always maintained constant, there is a tendency that the greater the rolling load, the greater the variations in rolling load become. (That is, the greater the rolling load is, the greater the influence of the horizontal pushing forces on the rolling load becomes.)

The present invention was made to overcome the above and other problems encountered in the rolling mills of the type described above. One of the objects of the present invention is therefore to eliminate the variations in rolling load even when the horizontal pushing forces applied to a work roll are varied. Another object of the present invention is to eliminate the variations in rolling loads at any time regardless of the magnitude of the rolling load.

BRIEF DESCRIPTION OF THE DRAWINGS

FIG. 1 showing a side view thereof while FIG. 2 is a view looking in the direction of the arrow II of FIG. 1;

DESCRIPTION OF THE PREFERRED EMBOIDMENTS

Figure 1:
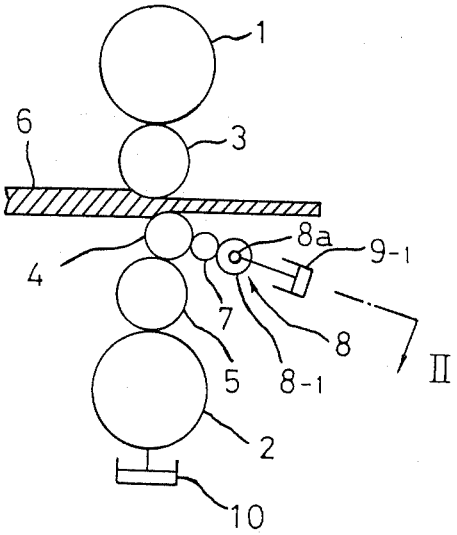
Fig.1 PRIOR ART
FIGS. 1 and 2 show schematically a rolling mill with a horizontal bending device.
Figure 2:
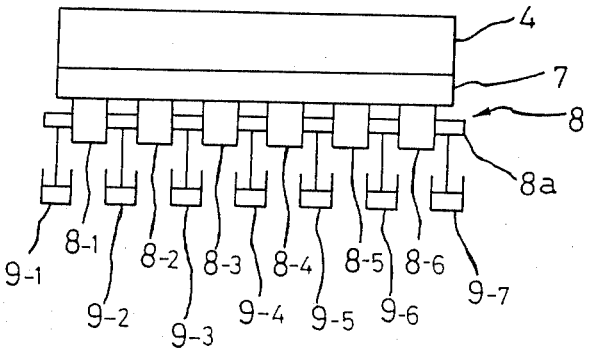
Fig.2 PRIOR ART
Figure 3:
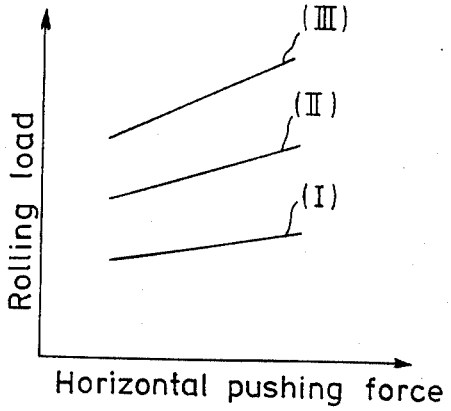
FIG. 3 shows the influence of the horizontal pushing force on the rolling road.
Figure 4:
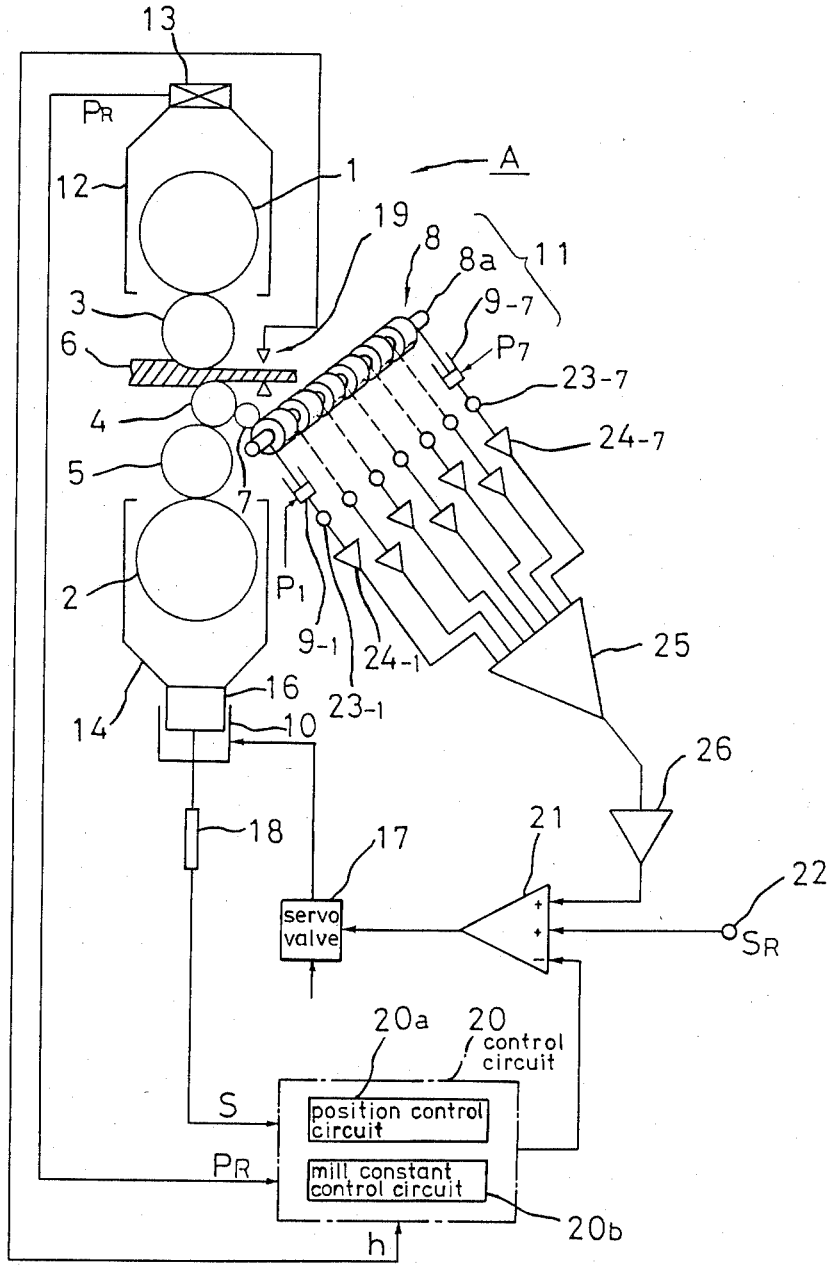
FIG. 4 is a schematic view of a first embodiment of the present invention.

Referring to FIG. 4 showing a first embodiment of the present invention, a five-high rolling mill generally indicated by reference character A comprises a pair of backup rolls 1 and 2, a pair of work rolls 3 and 4 and an intermediate roll 5. The lower work roll 4 is provided with a horizontal bending device 11 comprising a holding roll 7, a sectioned roll 8 and a plurality of hydraulic cylinders $9_1$–$9_7$ (pushing means). The above-described construction of the rolling mill A is substantially similar to that described above with reference to FIGS. 1 and 2. A load sensor 13 for detecting the rolling load $P_R$ is interposed between a mill housing (not shown) and a chock 12 of the upper backup roll 1. A reduction hydraulic cylinder 10 (rolling means) has its piston rod 16 (rolling drive body) connected to a chock 14 of the lower backup roll 2. Supplied to the hydraulic cylinder 10 is a working oil the pressure of which is controlled by a servo valve 17. A magnetic scale 18 is provided to detect the vertical position S of the piston rod 16 of the hydraulic cylinder 10. A thickness gage 19 is provided to measure the thickness h of a strip 6 leaving the work rolls 3 and 4.

The output signals respectively representative of the rolling load $P_R$, the vertical position S of the piston rod 16 and the thickness h of the strip 6 leaving the rolling mill A are applied to a control circuit 20 and the output signal of the control circuit 20 is applied to a subtraction input terminal of an adder 21. A rolling position setting signal $S_R$ for setting the position S of the piston rod 16 is applied through an input terminal 22 to one of addition input terminals of the adder 21. In response to the output signal derived from the adder 21, the servo valve 17 is controlled. The load sensor 13, the magnetic scale 18, the thickness gage 19, the control circuit 20, the adder 21 and the servo valve 17 constitute rolling control means for maintaining the thickness h of the strip 6 at a predetermined value. The control circuit 20 comprises a position control circuit 20*a* and a mill constant control circuit 20*b*. In response to the output signal representative of the vertical position S of the piston rod 16, the position control circuit 20*a* controls such that the position of the piston rod 16 may be maintained at the position indicated by the rolling position setting signal $S_R$ (which has a polarity which is increased as the piston 16 is moved in such a direction that the space between the work rolls 3 and 4 may be increased) applied to a terminal 22. In response to the output signals respectively representative of the position S of the piston rod 16, the reduction load $P_R$ and the thickness h of the strip 6 leaving the rolling mill A and in response to a mill constant of the rolling mill A, the mill constant control circuit 20*b* changes the position S of the piston rod 16 so that the thickness h of the strip 6 leaving the rolling mill A may be always maintained constant.

The hydraulic cylinders $9_1$–$9_7$ are provided with pressure sensors $23_1$–$23_7$ which are adapted to detect the pressures $P_1$–$P_7$ of the working oil supplied to the hydraulic cylinders $9_1$–$9_7$. (Alternatively, the hydraulic cylinders $9_1$–$9_7$ are provided with position sensors for detecting the positions of the piston rods (pushing drive bodies) in the hydraulic cylinders $9_1$–$9_7$.) The output signals from the pressure sensors $23_1$–$23_7$ are amplified by weighing amplifiers $24_1$–$24_7$, respectively, and are applied to an adder 25. The gains of some of the amplifiers $24_1$–$24_7$, for example those of the amplifiers $24_1$ and $24_7$ which corresponds to the ends of the shaft of the sectioned roll 8, are lowest. The output signal from the adder 25 is amplified by an amplifier 26 which determines a correction gain. The output signal from the amplifier 26 is applied to the other of the addition input terminals of the adder 21.

According to the first embodiment of the present invention, therefore, when the forces produced by the hydraulic cylinders $9_1$–$9_7$ and applied to the sectioned roll 8 are varied or when the reference positions of the piston rods or pushing drive bodies are varied in order to control the flatness of the strip 6, the horizontal pushing forces or the positions of the pushing drive bodies may vary so that the rolling load $P_R$ changes. However, even when the rolling load $P_R$ varies, the rolling force between the work rolls 3 and 4 is corrected so as to compensate for the variations in rolling load $P_R$. More particularly, when the horizontal pushing forces exerted to the lower work roll 4 are increased, the output signal from the amplifier 26 is increased. As a result, the piston rod 16 is moved in such a direction in which the space between the upper and lower work rolls is increased. On the other hand, when the horizontal pushing forces are decreased, the output signal from the amplifier 26 is decreased. As a result, the piston rod 16 is moved in such a direction in which the space between the upper and lower work rolls 3 and 4 is reduced.

Figure 5:
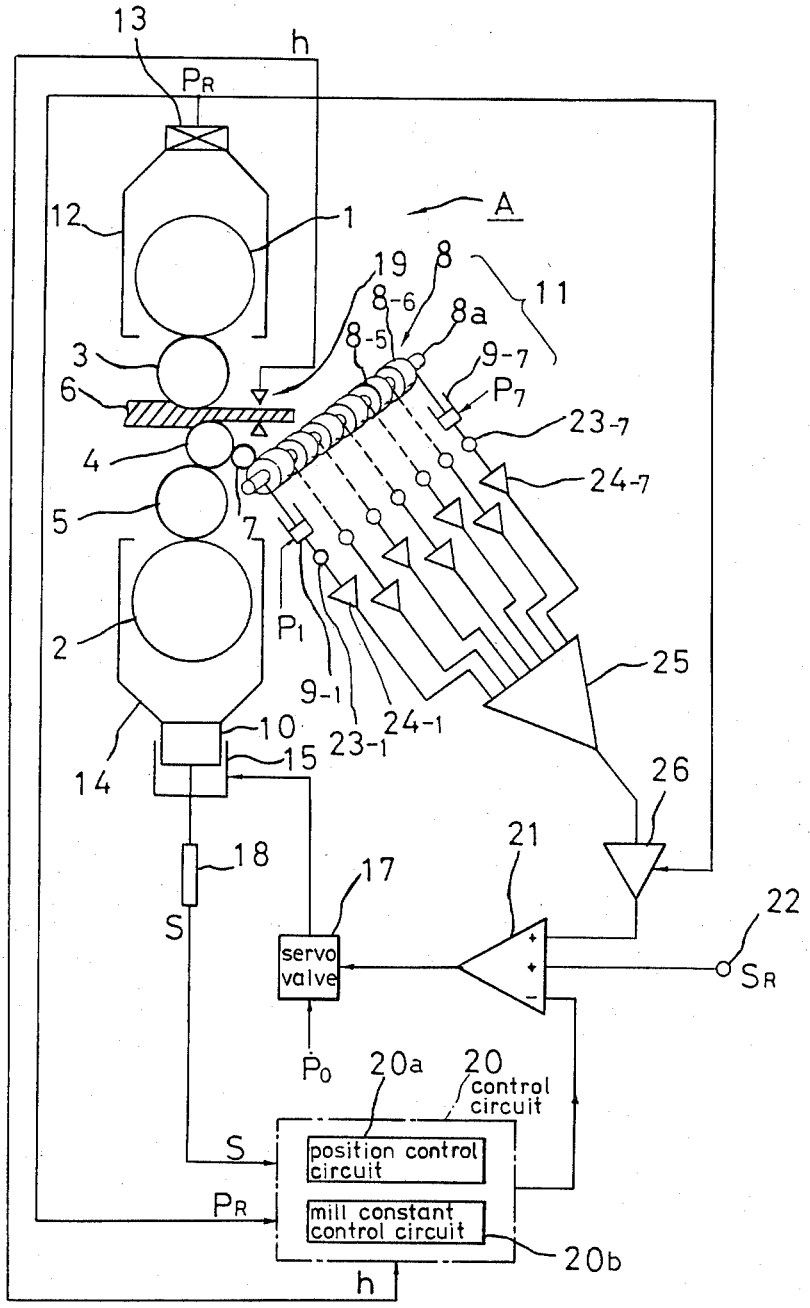
FIG. 5 is also a schematic view of a second embodiment of the present invention.

FIG. 5 shows another embodiment of the present invention in which the amplifier 26 is a gain variable type amplifier which amplifies the output signal of the adder 25 at a gain corresponding to the rolling load $P_R$. That is, the higher the rolling load $P_R$, the higher the gain becomes. The output signal from the variable gain amplifier 26 is applied to the other addition input terminal of the adder 21. The same reference numerals are used to designate similar parts throughout FIGS. 4 and 5.

As is the case of the first embodiment, when the horizontal pushing forces exerted to the lower work roll 4 are increased, the space between the upper and lower work rolls 3 and 4 is increased. On the other hand, when the horizontal pushing forces are reduced, the space between the upper and lower work rolls 3 and 4 is decreased. According to the second embodiment, the control gain in the above-described correction control is varied in response to the rolling load. As a result, even when the magnitude of the rolling load is varied so that the influence of the horizontal pushing forces on the rolling load varies, the appropriate rolling correction is always carried on. That is, when the rolling load $P_R$ is high, the gain of the variable gain amplifier 26 is increased so that a high degree of correction is made. On the other hand, when the rolling load $P_R$ is low, the gain of the variable gain amplifier 26 is lowered so that a small degree of correction is carried on.

In the first and second embodiments, the horizontal bending device 11 has been described as being disposed at the downstream side of the lower work roll, but it is to be understood that the present invention may be equally applied to a rolling mill in which one or both of the upper and lower work rolls are provided with the horizontal bending devices or in which the horizontal bending device is disposed at the upstream or downstream side of the work roll or rolls. In addition, advantageously the control gain may be varied in response to the diameters of the upper and lower work rolls, the diameter of the intermediate roll and the thickness and width of a strip.

The effects, features and advantages of the present invention may be summarized as follows:

(I) The pushing forces exerted to a work roll or the positions of the pushing drive bodies with respect to a direction of the pushing forces are detected and applied to the input point of the rolling position setting signal in the rolling control device. Therefore, when the horizontal forces are exerted to a work roll so as to bend it, thereby controlling the flatness of a strip being rolled, the variations in rolling load due to the variations in the horizontal pushing forces can be eliminated. As a result, the variations in thickness of the strip leaving the work roll can be prevented.

(II) When the horizontal forces are exerted to a work roll so that the work roll is bent and consequently the flatness of a strip being rolled is controlled, the variations in rolling load due to the variations in the horizontal pushing forces can be eliminated regardless of the magnitude of the rolling load.

What is claimed is:

1. In a rolling mill of the type having a rolling device responsive to displacement of a rolling drive body for producing a vertical rolling force between a pair of work rolls, a horizontal bending device for exerting pushing forces to at least one of said pair of work rolls in a direction substantially in parallel with passage of a strip being rolled, thereby bending the work roll, and a rolling control device for receiving a rolling position setting signal so as to set a position of said rolling drive body and for controlling said rolling device such that a thickness of the strip leaving said pair of work rolls can be maintained constant, a method for controlling correction in the rolling mill which comprises detecting the forces exerted by said horizontal bending device to the corresponding work roll or detecting a position of said rolling drive body in a direction of said pushing forces and applying a thus detected signal to an input point of said rolling position setting signal in said rolling control device, whereby variations in rolling load due to the pushing forces can be eliminated or cancelled.

2. A rolling mill comprising: a pair of work rolls, and a rolling drive body connected to said rolls, a rolling device responsive to displacement of said rolling drive body for producing a vertical rolling force between said pair of work rolls, a horizontal bending device operatively connected to at least one of said work rolls and including a plurality of pushing means for individually exerting pushing forces to at least one roll of said pair of work rolls in a direction substantially in parallel with passage of a strip being rolled between said work rolls, and a rolling control device operatively connected to said rolling drive body and said bending device, for receiving a rolling position setting signal therefrom for setting a position of said rolling drive body and for controlling said rolling device such that a thickness of the strip leaving the pair of work rolls may be maintained constant, said control device comprising sensors connected to said plurality of pushing means for detecting the pushing forces produced by said plurality of pushing means or for detecting positions, in a direction of said pushing forces, of individual pushing drive bodies in said pushing means, and an operational means operatively connected to said sensors for obtaining a sum of output signals from said sensors and for applying an output signal derived from said sum to an input point of said rolling position setting signal in said rolling control device with such a polarity that variations in rolling load due to the pushing forces produced by said plurality of pushing means can be eliminated or cancelled.

3. A rolling mill comprising: a pair of work rolls and a rolling drive body connected to said rolls, a rolling device response to displacement of said rolling drive body for producing a vertical rolling force between said pair of work rolls, a horizontal bending device operatively connected to at least one of said work rolls and including a plurality of pushing means for individually exerting pushing forces to at least one of said pair of work rolls in a direction substantially in parallel with passage of a strip being rolled between said work rolls, and a rolling control device operatively connected to said rolling drive body and said bending device, for receiving a rolling position setting signal therefrom for setting a position of said rolling drive body and for controlling said rolling device such that a thickness of the strip leaving the pair of work rolls may be maintained constant, said control device comprising a detection means connected to said bending device, for detecting the pushing forces exerted from said horizontal bending device to the corresponding work roll or for detecting positions, in a direction of the pushing force, of said pushing drive bodies in said pushing means, a load sensor connected to said work rolls for sensing a rolling load, and a level adjustment means connected to said sensor and said detection means for adjusting a level of an output signal from said detection means in response to an output signal from said load sensor, whereby an output signal from said level adjustment means is applied to an input point of said rolling position setting signal in said rolling control device so that variations in rolling load due to said pushing forces can be eliminated or cancelled.

* * * * *